US005779104A

United States Patent [19]

Reidel

[11] Patent Number: 5,779,104

[45] Date of Patent: Jul. 14, 1998

[54] DEVICE FOR GENERATING AND DISPENSING FOAM

[75] Inventor: Hermann Reidel, Karlstein, Germany

[73] Assignee: Eureka Development Ltd., Germany

[21] Appl. No.: 732,434

[22] PCT Filed: Apr. 24, 1995

[86] PCT No.: PCT/DE95/00547

§ 371 Date: Nov. 1, 1996

§ 102(e) Date: Nov. 1, 1996

[87] PCT Pub. No.: WO95/29759

PCT Pub. Date: Nov. 9, 1995

[30] Foreign Application Priority Data

May 2, 1994 [DE] Germany ..... 9407178 U

[51] Int. Cl.[6] ..... B67D 5/58

[52] U.S. Cl. ..... 222/190; 222/321.8

[58] Field of Search ..... 222/190, 321.7, 222/321.8, 321.9, 383.1, 385, 381; 239/343

[56] References Cited

U.S. PATENT DOCUMENTS

| | | | |
|---|---|---|---|
| 1,896,624 | 6/1933 | Hollands . | |
| 4,349,131 | 9/1982 | Arabian | 222/135 |
| 4,932,567 | 6/1990 | Tanabe et al. | 239/343 |
| 5,271,530 | 12/1993 | Uehira et al. | 222/190 |
| 5,310,093 | 5/1994 | Bennett | 239/343 |
| 5,462,208 | 10/1995 | Stahley et al. | 222/190 |

*Primary Examiner*—Philippe Derakshani
*Attorney, Agent, or Firm*—Webb Ziesenheim Bruening Logsdon Orkin & Hanson, P.C.

[57] ABSTRACT

The invention relates to a device for generating and metering foam, especially foamed soap. To prevent further dispensing of drips of residual foam in a foam outlet channel after the quantity required has been supplied, the device is constructed in such a way that the underpressure subsisting on the return stroke of a piston in an air chamber is effective in the foam outlet channel and sucks residual foam back.

5 Claims, 4 Drawing Sheets

DEVICE FOR GENERATING AND DISPENSING FOAM

BACKGROUND OF THE INVENTION

1. Field of the Invention

The invention relates to an appliance for the generation and discharge of foam, in particular soap foam.

2. Description of the Prior Art

Such appliances are installed at washing points of, for example, bathing establishments and toilets, in order, for example for washing the hands, to generate and discharge a metered quantity of soap foam. A simple actuation of the appliance by hand is sufficient for this purpose, in order to generate and at the same time issue a specific quantity of foam. Appliances of this type can be part of a foam dispenser installed fixedly above or at the washing point or also be arranged as an attachment directly on a liquid storage tank.

U.S. Pat. No. 1,896,624 discloses a soap-foam dispenser which consists of a housing having a cylindrical air chamber of variable volume and of a device, arranged coaxially thereon, for conveying foamable liquid out of a tank simultaneously with the conveyance of air, the device being formed from a plunger piston retractable into a suction-side [sic] with non-return valve by the actuating element for the compression of air, and both the air chamber and a chamber provided with the non-return valve being connected, in the device, to a foaming chamber, to which the foam-outlet duct is connected. The housing part surrounding the air chamber serves at the same time as an actuating element for the compression of air and for the conveyance of the air into the foaming chamber which is arranged in a part of the foam-outlet duct fixed laterally to the housing. When a compression stroke for the air ends, the foam expulsion also ceases, that is to say formed foam remains both in the foaming chamber and in the foam-outlet duct, runs out or becomes encrusted in the course of time, particularly when the appliance remains unused for a relatively long time. No return suction of the foam occurs, because the air chamber does not acquire its thrust of air through the foam-outlet duct, but through an orifice in the wall of the air chamber.

An attempt was made to solve this problem with a foam dispenser according to European Patent 0,019,582, in that, after the foam discharge, residual foam remaining in the mixing chamber and in the foam-outlet duct is blown out. However, this is at the expense of a special construction of the appliance which makes it possible first to generate and expel foam and then subsequently to expel the residual foam with a further air blast, this usually always entailing an "afterdrip" of foam. Apart from that, a special air-cushion chamber is necessary, so that the liquid which has flowed in there from a storage tank can be driven by means of a valve-slide piston into the foaming chamber arranged stationarily in the dispenser housing, whilst the slide piston has to be guided with an exact fit in a cylinder.

Proceeding from a foam dispenser according to U.S. Pat. No. 1,896,624, the object on which the present invention is based is to provide a foam dispenser which, whilst having a simple construction, makes the subsequent blow-out unnecessary and prevents a possible afterdrip of foam or of foam which has become liquid again.

SUMMARY OF THE INVENTION

This object is achieved by means of an appliance according to the present invention having the following features:

the appliance consists of a housing having a cylindrical air chamber of variable volume and of a device, arranged coaxially thereon, for conveying foamable liquid out of a tank simultaneously with the conveyance of air, the device being formed from a plunger piston retractable into a [sic] on the suction side with non-return valve by the actuating element for the compression of air, and both the air chamber and a chamber provided with the non-return valve being connected, in the device, to a foaming chamber, to which the foam-outlet duct is connected. At the same time, there is arranged in the air chamber a piston having a central insert which is fixedly connected to the piston. The unit formed from the insert and piston is supported against the bottom of the air chamber by means of a spring. Arranged in the insert is an air duct which connects the foaming chamber, arranged centrally in the insert, to the air chamber. There projects into the insert in a manner directed towards the foaming chamber and fixedly connected thereto the open end of the plunger piston which is provided with a conveying duct and which is displaceable in the device for the conveyance of liquid, and there is arranged in the air duct, upstream of its entry into the foaming chamber, a foam return-suction valve which connects the air duct to the foam-outlet duct.

Apart from the fact that, in the foam dispenser according to the invention, all the elements necessary for the supply of air and the formation of foam are concentrated in or on the actuating element for changing the volume of the air chamber, specifically also the foam-outlet duct, this foam dispenser utilizes the return stroke brought about positively by the spring, in order to cause the suction occurring thereby to take effect on the foam-outlet duct and to suck back residual foam located therein. There is therefore neither a follow-up ejection of foam by blowing out, as in the foam dispenser according to European Patent 0,019,582, nor an afterdrip of foam or of foam which has become liquid again, this being possible in the foam dispenser according to U.S. Pat. No. 1,896,624.

The appliance according to the invention and advantageous embodiments are explained in more detail below by means of the graphical representation of exemplary embodiments.

DETAILED DESCRIPTION OF THE PREFERRED EMBODIMENTS

Figure 1:
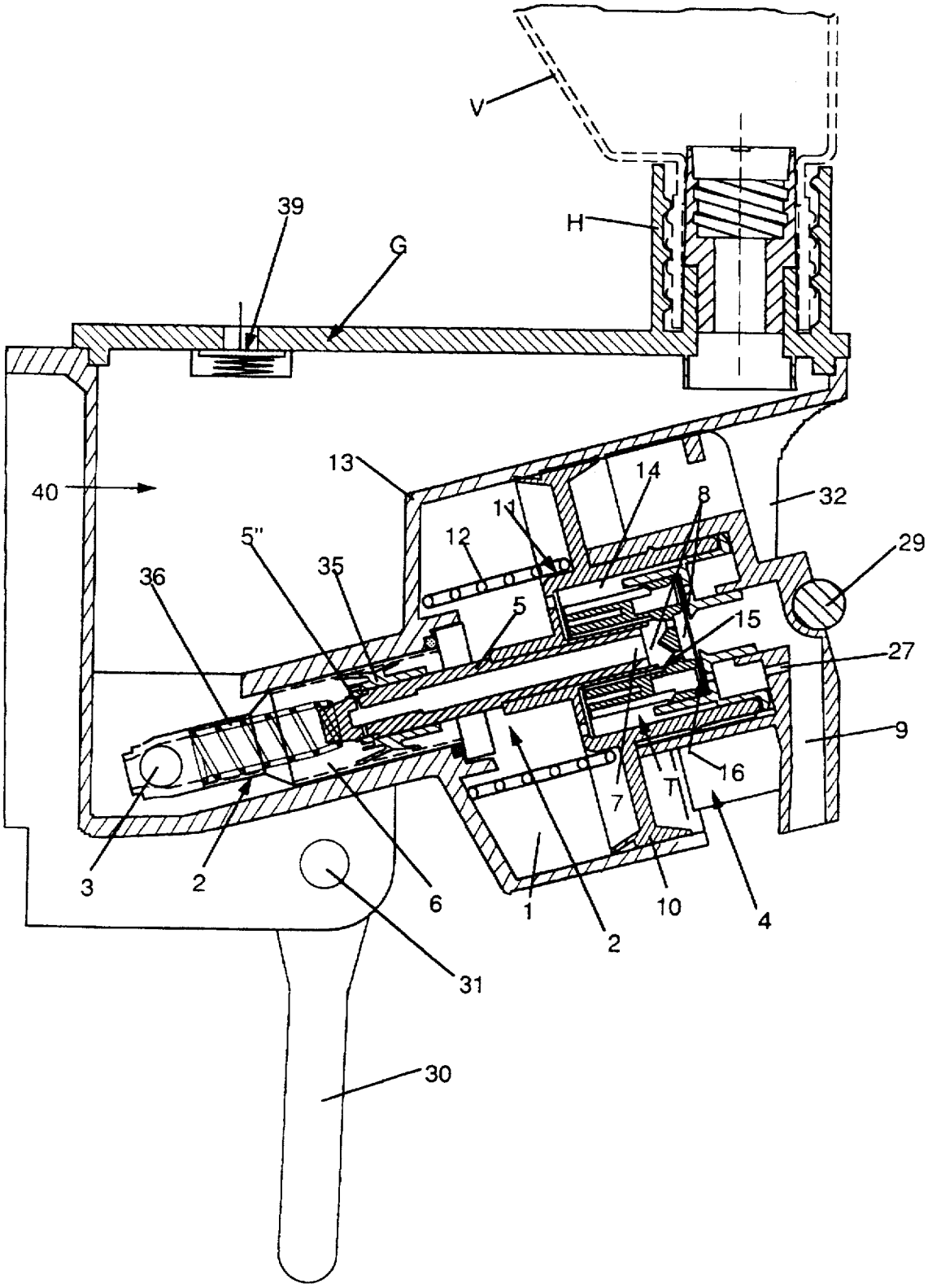
FIG. 1 shows a section through a preferred embodiment of the appliance.
Figure 2:
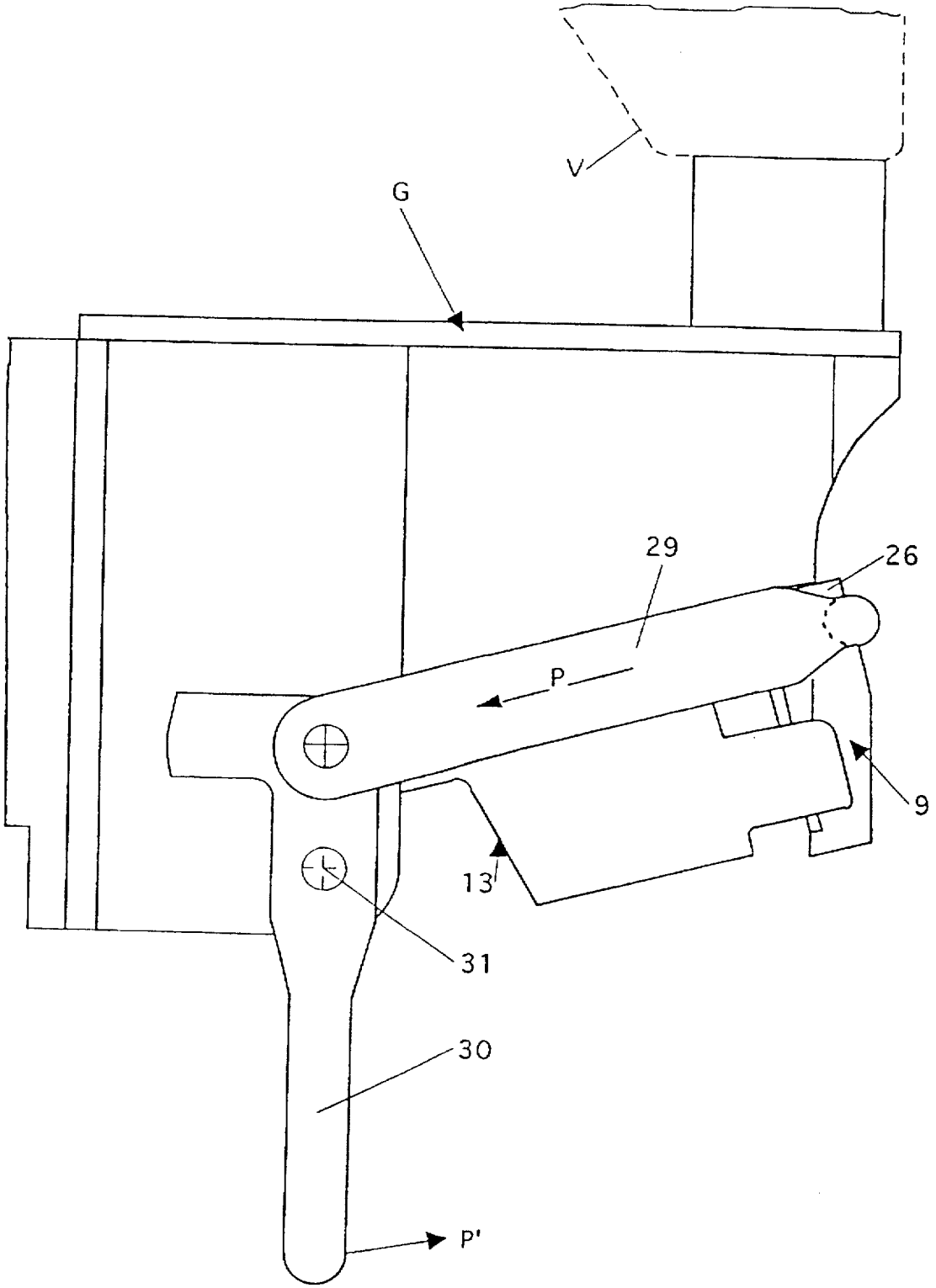
FIG. 2 shows the appliance according to FIG. 1 in a side view.

As is evident from FIG. 1, the appliance according to the invention consists of a housing G having a cylindrical air chamber 1 of variable volume and of a device 2, arranged coaxially thereon, for conveying foamable liquid out of a tank V simultaneously with the conveyance of air, the device 2 (see also FIG. 5) being formed from a plunger piston 5 retractable on the suction side with non-return valve 3 by the actuating element 4 for the compression of air, and both the air chamber 1 and a chamber 6 provided with the non-return valve 3 being connected, in the device 2, to a foaming chamber 8, to which the foam-outlet duct 9 is connected. Arranged in the air chamber 1 is a piston 10 having a central insert 11 which is fixedly connected to the piston 10. The unit formed from the insert 11 and piston 10 is supported against the bottom 13 of the air chamber 1 by means of a spring 12. Arranged in the insert 11 is an air duct 14 which connects the foaming chamber 8, arranged centrally in the insert 11, to the air chamber 1. There projects into the insert 11 in a manner directed towards the foaming chamber 8 and connected fixedly thereto the open end 7 of the plunger piston 5 which is provided with a conveying duct 5' and which is displaceable in the device 2 for the conveyance of liquid, and, furthermore, there is arranged in the air duct 14, upstream of its entry 15 into the foaming chamber 8, a foam return-suction valve 16 which connects the air duct 14 to the foam-outlet duct 9.

For reasons of simple production, the unit, which is formed from the piston 10 and insert 11 and which constitutes as a whole the actuating element 4 for changing the volume of the air chamber 1, is formed from a plurality of parts which, however, are all fixedly connected to one another.

Figure 3:
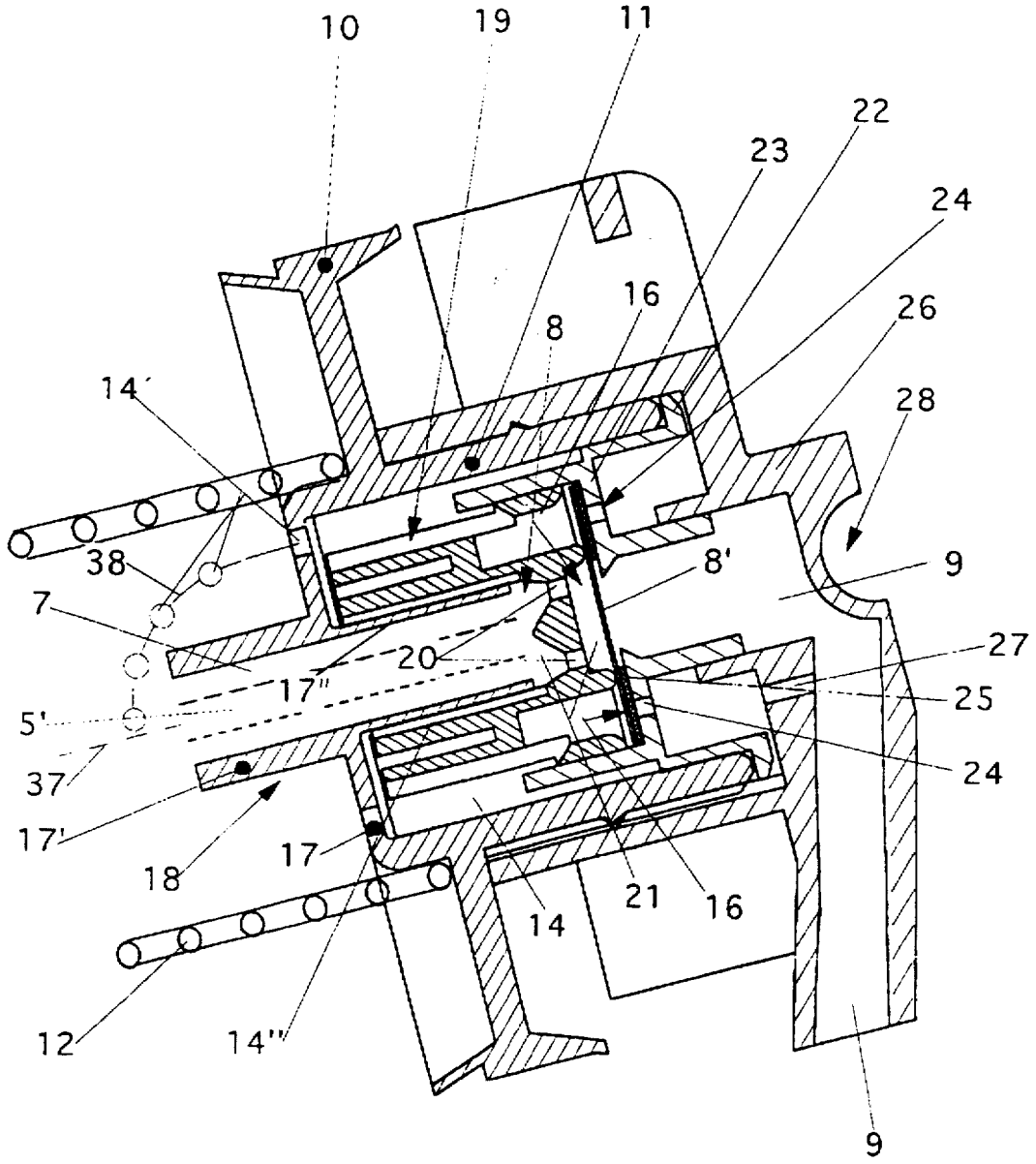
FIG. 3 shows the actuating element according to FIG. 1 separately and in section.

As shown separately in FIG. 3 for the sake of clarity, the sleeve-shaped insert 11 forms one piece with the piston 10. The bottom 17 of the insert 11 has orifices 14' and a sleeve 18 which extends on both sides and of which the part 17' projecting into the air chamber 1 receives the open end 7 of the plunger piston 5 and the inward-directed part 17" of which forms the inner wall of a part 14" of the air duct 14, annularly cylindrical as a whole, which is limited, on the other hand, by a further sleeve 19. This sleeve 19 contains orifices 20 for the air above the annular entry 15, the spaces 21 forming the foaming chamber 8, downstream of which is located towards the foam-outlet duct 9 a foaming element 8'. Arranged above the sleeve 19 is a third sleeve 22 which is likewise seated fixedly in the insert 11. Arranged in the bottom 23 of this sleeve 22 are a plurality of orifices 24 which, together with an elastic ring 25, form the foam return-suction valves 16. Seated on the entire insert 11 is a cowl 26 which also contains the foam-outlet duct 9, from which a suction bore 27 makes the suction connection with the foam return-suction valves 16. This cowl 26 also has a recess 28 for a pull clip 29 which is adjusted in the direction of the arrow P by a hand lever 30 when the latter rotates in the direction of the arrow P' about its axis 31 on the housing 1. At the same time, the piston 10 is pressed into the air chamber 1 and compresses the air which passes through the orifices 14' into the air-guide ducts 14, 14" and from there to the annular entry 15 into the space 21 (premixing chamber) where the air meets the liquid to be foamed. When the entire unit consisting of the piston 10 and insert 11 is pressed down, the plunger piston 5 (see FIG. 5) fixedly connected thereto is also pressed into the chamber 6. During the penetration of the plunger piston 5, transverse bores 5" leading to the conveying duct 5' are exposed, and the liquid displaced by the plunger piston rises upwards in the conveying duct 5' into the foaming chamber 8. The foam formed in the latter then emerges at the end of the foam-outlet duct 9 and is received there by the palm of the user's hand. As soon as the lever 30 is released, the unit consisting of the piston 10, insert 11 and plunger piston 5 is reset again by means of the spring 12. This resetting operation ensures that new liquid is sucked into the chamber 6 of the device 2 and that a vacuum is formed in the air chamber 1 and opens the foam return-suction valves 16, so that the vacuum can also take effect in the foam-outlet duct via the bore 27 and suck back the residual foam located there into the cavities of the insert 11, that is to say into the spacious part of the air duct 14, out of which the foam or the possibly reformed liquid is then entrained by the air again when the next actuation occurs.

Figure 4:
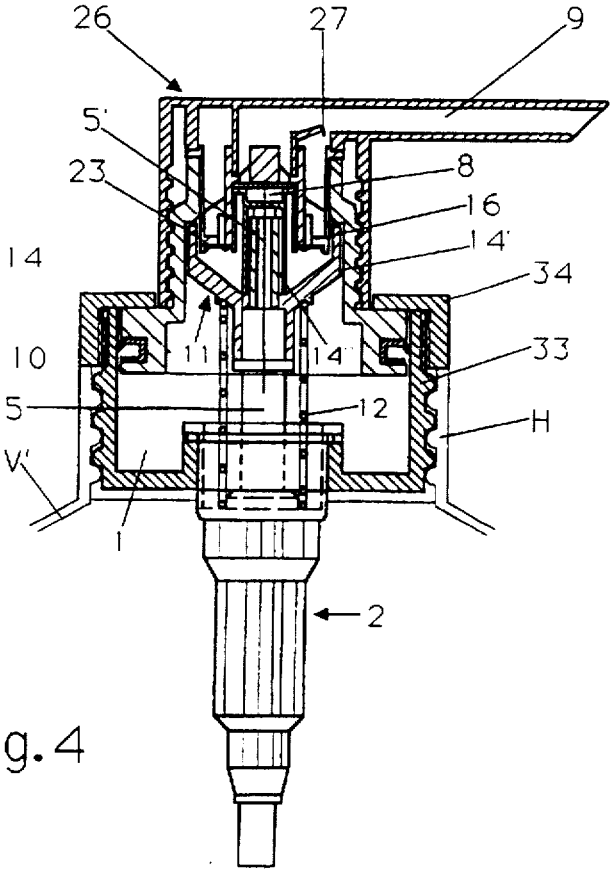
FIG. 4 shows, in section, another embodiment for direct arrangement on a liquid storage tank.
Figure 6:
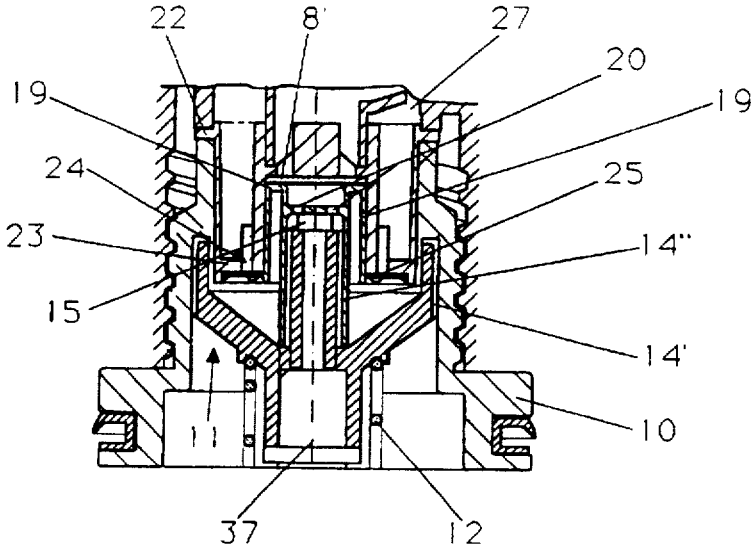
FIG. 6 shows, enlarged, a section through the actuating element for the conveyance of air and liquid and formation of foam according to FIG. 4.

The appliance which is illustrated in FIGS. 4 and 6 and which is intended for direct attachment onto a liquid tank V' works on the same principle. Corresponding parts of this embodiment bear corresponding reference symbols, so that there is no need to describe them again.

The housing G in the embodiment according to FIG. 1 is formed, here, by the neck H of the liquid tank V', into which the air chamber 1 is screwed. A stop 32 in the embodiment according to FIG. 1, which limits the stroke of the piston 10 together with its insert 11, is formed, in the embodiment according to FIG. 4, by a stop ring 34 screwed onto the wall 33 of the air chamber 1.

Figure 5:
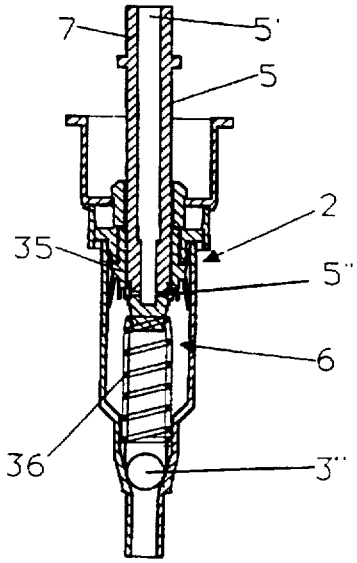
FIG. 5 shows the device for the conveyance of liquid separately and in section.

As a comparison of FIGS. 1 and 5 in terms of the devices 2 shows, these are largely identical, with the exception of slightly different details of construction. Here, as there, the plunger piston 5 slides in a stationary sealing sleeve 35, and the non-return valve 3 also has a spring 36 which likewise participates in the resetting operation.

In the embodiment according to FIGS. 4 and 6, the air-inflow orifice 14' constitutes an annular gap, whereas, in the embodiment according to FIGS. 1 and 3, this is formed from a plurality of such orifices 14' which are arranged distributed on a semicircle 38, upper in relation to the mid-axis 37, thus ensuring, in this embodiment, that foam which is sucked back cannot pass into the air chamber 1.

Whereas, in the embodiment according to FIGS. 4 and 6, the air chamber 1 together with the unit consisting of the piston 10 and insert 11 is seated directly in the neck H of the liquid tank V', in the embodiment according to FIG. 1 the liquid tank V is seated in a neck H of the housing G which is provided with a ventilating valve 39 and in which, as shown, the device 2 having the air chamber 1 is arranged, that is to say, in this case, the foamable liquid is sucked up out of the chamber 40 of the housing G.

I claim:

1. An apparatus for the generation and metered discharge of foam comprising:

a housing having a cylindrical air chamber of variables volume;

a device arranged coaxially on the housing for conveying foamable liquid out of a tank simultaneously with the conveyance of air, wherein the device comprises a plunger piston retractable on a suction side of the device and defines a chamber receiving a non-return valve having an actuating element for the compression of air, wherein the air chamber and the chamber receiving the non-return valve are each connected to a foaming chamber; and a foam-outlet duct connected to the foaming chamber, the device further comprising:

a piston arranged in the air chamber, the piston having a central insert fixedly connected to the piston, a unit formed from the central insert and the piston being supported against a bottom of the air chamber by a spring;

an air duct arranged centrally in the central insert, the air duct being connected to the air chamber;

an open end of the plunger piston projecting into the central insert towards the foaming chamber and fixedly connected to the central insert, the plunger piston having a conveying duct and being displaceable in the device for the conveyance of liquid; and a foam return-suction valve arranged in the air duct upstream of the foaming chamber, the foam return-suction valve connecting the air duct to the foam-outlet duct.

2. The device according to claim 1, wherein the central insert comprises a sleeve integrally formed with the piston, wherein a part of the sleeve projects into the air chamber and receives the open end of the plunger piston, the central insert further comprising a second sleeve for limiting a part of the air duct, wherein the second sleeve defines an entry into the foaming chamber.

3. The device according to claim 2, including a third sleeve inserted in the insert, the third sleeve having a bottom portion defining a plurality of orifices, wherein the orifices together with an elastic ring, form a plurality of foam return-suction valves.

4. The device according to claim 2, including a cowl arranged on the insert, the cowl defining the foam-outlet duct and a bore, wherein the bore pneumatically connects the foam-outlet duct to the foam return-suction valves.

5. The device according to claim 4, wherein the cowl defines a recess for receiving a pull clip, wherein the pull clip is coupled to a hand lever pivotably mounted on the housing.

* * * * *

UNITED STATES PATENT AND TRADEMARK OFFICE

CERTIFICATE OF CORRECTION

PATENT NO. : 5,779,104

DATED : July 14, 1998

INVENTOR(S) : Hermann Reidel

It is certified that error appears in the above-identified patent and that said Letters Patent is hereby corrected as shown below:

Claim 1 Column 4 Lines 48-49 "variables volume;" should read --variable volume;--.

Signed and Sealed this

Tenth Day of November 1998

Bruce Lehman

*Attest:*

BRUCE LEHMAN

*Attesting Officer*

*Commissioner of Patents and Trademarks*